US008690281B2

(12) United States Patent
Oshima et al.

(10) Patent No.: US 8,690,281 B2
(45) Date of Patent: Apr. 8, 2014

(54) CAPACITIVE LOAD DRIVING CIRCUIT, LIQUID EJECTING APPARATUS, AND MEDICAL APPARATUS

(75) Inventors: Atsushi Oshima, Shiojiri (JP); Kunio Tabata, Shiojiri (JP); Hiroyuki Yoshino, Suwa (JP); Noritaka Ide, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/295,971

(22) Filed: Nov. 14, 2011

(65) Prior Publication Data

US 2012/0120136 A1 May 17, 2012

(30) Foreign Application Priority Data

Nov. 15, 2010 (JP) ..... 2010-254577

(51) Int. Cl.
*B41J 29/38* (2006.01)

(52) U.S. Cl.
USPC ..... 347/10

(58) Field of Classification Search
CPC ..... B41J 2/04541
USPC ..... 347/9–11
See application file for complete search history.

(56) References Cited

U.S. PATENT DOCUMENTS

| | | | | |
|---|---|---|---|---|
| 7,244,007 | B2 | 7/2007 | Ishizaki | |
| 7,571,989 | B2 | 8/2009 | Ishizaki | |
| 7,746,127 | B2 | 6/2010 | Miyazaki et al. | |
| 7,798,591 | B2 | 9/2010 | Ishizaki | |
| 8,262,183 | B2 * | 9/2012 | Oshima et al. | 347/10 |
| 2010/0045714 | A1 | 2/2010 | Ishizaki | |
| 2011/0109674 | A1 | 5/2011 | Oshima et al. | |
| 2011/0234702 | A1 | 9/2011 | Oshima et al. | |
| 2011/0242172 | A1 | 10/2011 | Yoshino et al. | |
| 2011/0254887 | A1 | 10/2011 | Ide et al. | |

FOREIGN PATENT DOCUMENTS

| | | | |
|---|---|---|---|
| JP | 2005-329710 | A | 12/2005 |
| JP | 2007-168172 | A | 7/2007 |
| JP | 2007-190708 | A | 8/2007 |
| JP | 2009-131990 | A | 6/2009 |
| JP | 2009-153272 | A | 7/2009 |
| JP | 2010-046989 | A | 3/2010 |
| JP | 2011-088294 | A | 5/2011 |
| JP | 2011-101972 | A | 5/2011 |
| JP | 2011-201218 | A | 10/2011 |
| JP | 2011-207069 | A | 10/2011 |

* cited by examiner

*Primary Examiner* — An Do
(74) *Attorney, Agent, or Firm* — Maschoff Brennan

(57) ABSTRACT

A modulated signal is generated by performing pulse modulation of a drive waveform signal that is a reference for a drive signal to be applied to a capacitive load, and the drive signal is generated by performing power amplification of the acquired modulated signal and then smoothing the power-amplified modulated signal. Then, negative feedback of the drive signal applied to the capacitive load is applied to the drive waveform signal that is the reference for the drive signal. At this time, a predetermined analog compensation process for smoothing gain characteristics in a frequency band included in the drive signal is performed for the drive signal, then the acquired signal is converted into a digital signal, and negative feedback of the digital signal is applied to the drive waveform signal.

5 Claims, 14 Drawing Sheets

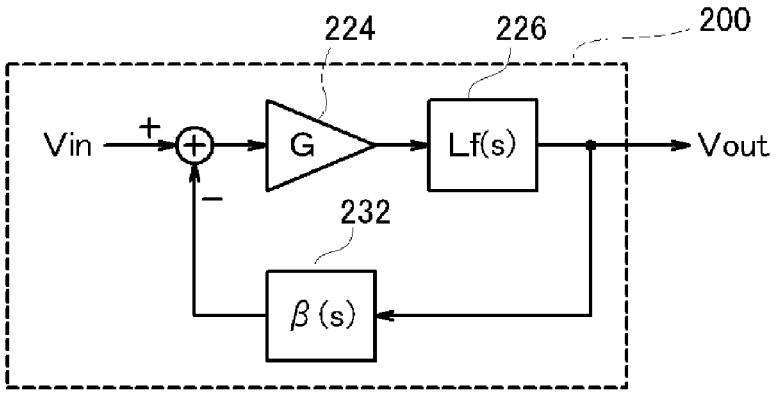
FIG. 6A
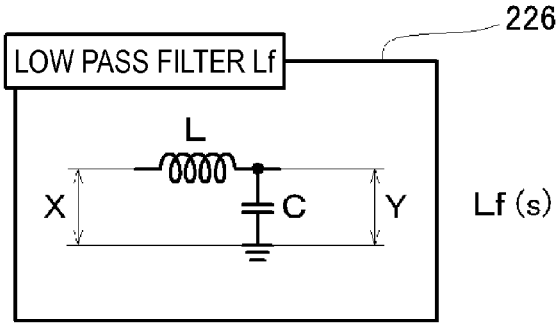
$$Lf(s) = \frac{Y(s)}{X(s)} = \frac{1}{s^2LC + 1}$$
FIG. 6B
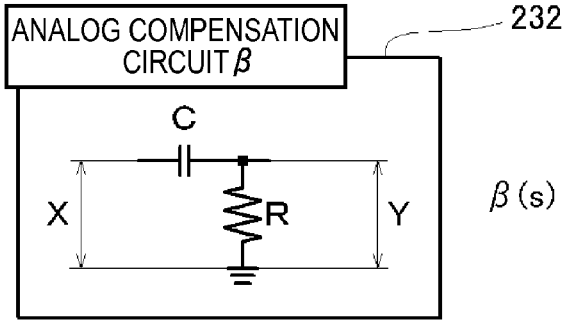
$$\beta(s) = \frac{Y(s)}{X(s)} = \frac{1}{1 + \frac{1}{CRs}}$$
FIG. 6C
$$H(s) = \frac{Vout(s)}{Vin(s)} = \frac{1}{\beta(s) + \frac{1}{GLf(s)}}$$
FIG. 6D

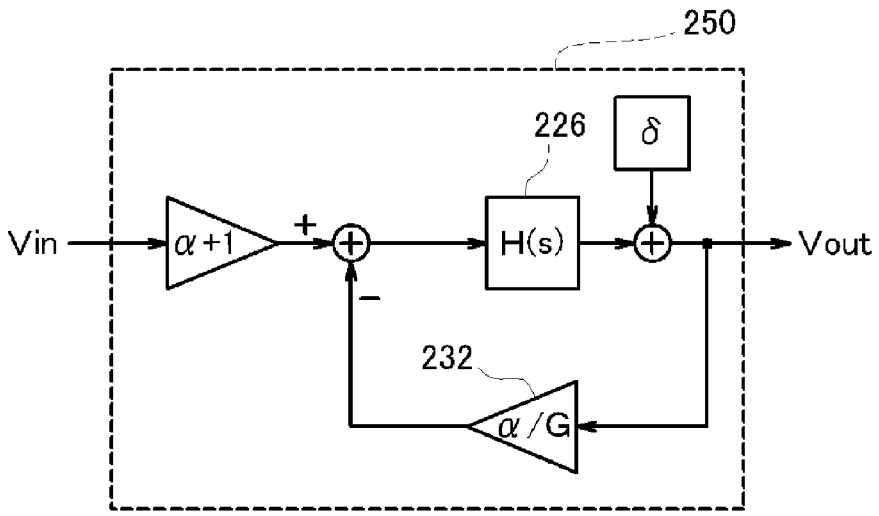

FIG.11A $$Vout = \left\{ (1+\alpha)Vin - (\alpha/G)Vout \right\} H(s) + \delta$$

FIG.11B $$Vout = \underbrace{\frac{(1+\alpha)H(s)}{1+\alpha H(s)/G} Vin}_{\text{SIGNAL COMPONENT}} + \underbrace{\frac{1}{1+\alpha H(s)/G} \delta}_{\text{EXTERNAL DISTURBANCE COMPONENT}}$$

FIG.11C

IN CONDITION OF $H(s) \fallingdotseq G$ $$Vout \fallingdotseq \underbrace{G\ Vin}_{\text{SIGNAL COMPONENT}} + \underbrace{\frac{1}{1+\alpha} \delta}_{\text{EXTERNAL DISTURBANCE COMPONENT}}$$

FIG.11D

CAPACITIVE LOAD DRIVING CIRCUIT, LIQUID EJECTING APPARATUS, AND MEDICAL APPARATUS

BACKGROUND

1. Technical Field

The present invention relates to a technique for driving a capacitive load of which a capacitive component changes or a technique for driving a plurality of capacitive loads having different capacitive components in a switching manner.

2. Related Art

There are many actuators, which operate by applying a predetermined driving signal thereto, such as an ejection head mounted in an ink jet printer and the like. In a case where the driving signal is generated by using an analog amplifier circuit, a large current flows through the circuit, whereby the power consumption is high. As a result, the power efficiency is low, and the size of a circuit substrate is large. In addition, since the consumed power is converted into heat, a large heat radiation plate is necessary, whereby the size of the substrate further increases.

Thus, a technique is proposed in which a drive waveform signal as a reference for a drive signal is converted into a modulated signal once, the acquired modulated signal is amplified, and then an amplified drive signal is acquired through a low pass filter, instead of directly amplifying an analog drive signal (JP-A-2007-168172). The amplification of the modulated signal can be realized by only switching of a switch to be turned On or Off. Furthermore, the low pass filter can be realized by using an LC circuit acquired by combining a coil and a capacitor, and accordingly, power is not consumed in principle. Thus, according to the proposed technique, the drive signal can be generated without incurring high power consumption, and as a result, not only the power efficiency is improved but also the size in the circuit substrate can be decreased. However, according to the proposed technique, since the low pass filter is configured by the LC circuit, there is a resonance characteristic in a high-frequency band, whereby it is difficult to acquire a desired drive signal. In order to suppress the resonance characteristic, there is a method in which a resistor is inserted into the low pass filter. However, according to such a method, power is consumed when a current flows through the resistor, and accordingly, an original purpose of decreasing the size in the circuit substrate by improving the power efficiency diminishes.

Thus, a technique is proposed in which a drive signal applied to an actuator is converted by using an A/D converter, and a stable drive signal is acquired by performing a stabilization process such as differential calculation as digital signal processing so as to suppress the resonance characteristic (JP-A-2010-46989). According to this technique, by configuring a state stabilizing mechanism that is used for estimating the magnitude of a current flowing through a piezoelectric device based on a digital drive signal and a digital load voltage signal, the resonance characteristic of the low pass filter can be suppressed without using the resistor.

However, according to the proposed technique, the digital signal processing of the state stabilizing mechanism is complicated, and it takes ten to several tens of clocks to complete the process, and accordingly, a delay time required for negative feedback is long. For example, in a case where a clock frequency of a digital signal processing IC is several tens of MHz, it takes several hundreds of nanoseconds to several microseconds to complete the process. Thus, in order to increase a frequency of a frequency component of the drive signal up to several hundreds of kHz, for a period component of several microseconds as a reciprocal of the frequency, a total delay time including the time required for the digital signal processing incurs a phase delay of 180 degrees or more, whereby the stability of a negative-feedback system decreases. In addition, in a case where a specified capacitive load to be driven changes, there is a problem in that the drive signal may be distorted. The reason for this is as follows. For example, in an ejection head mounted in an ink jet printer, ink is ejected by driving a piezoelectric device, and the number of piezoelectric devices simultaneously driven markedly changes depending on an image to be printed. Since the piezoelectric device is a capacitive load having a capacitive component, an increase in the number of piezoelectric devices to be driven means an increase in the capacitance of the low pass filter for generating the drive signal. Thus, when the capacitance increases, the frequency characteristics of the low pass filter change. As a result, the acquired drive signal is distorted due to the influence of the change in the frequency characteristics. In addition, in a case where a piezoelectric device is used as an actuator built in an attachment for an apparatus that is used with attachments having different characteristics being attached in a switched manner, a similar problem may occur. In other words, since the magnitude of the capacitive component of the piezoelectric device differs depending on the installed attachment, the frequency characteristics of the low pass filter changes, and accordingly the drive signal may be distorted.

SUMMARY

An advantage of some aspects of the invention is that it provides a technique for generating a stable drive signal with high accuracy while suppressing the resonance characteristics of a low pass filter, even in case where a frequency component of the drive signal is set to be raised as high as several hundreds of kHz or there is an external disturbance, increasing the power efficiency, and decreasing the size of a circuit substrate.

An aspect of the invention is directed to a capacitive load driving circuit that applies a predetermined drive signal to a capacitive load having a capacitive component so as to drive the capacitive load. The capacitive load driving circuit includes: a drive waveform generator that outputs a drive waveform signal that is a reference for the drive signal in a form of a digital signal; a digital arithmetic circuit that performs digital calculation of a signal, which is acquired by applying negative feedback of a digital compensation signal generated in a form of a digital signal based on the drive signal applied to the capacitive load to the drive waveform signal, so as to be generated; a modulator that generates a modulated signal by performing pulse modulation of an output of the digital arithmetic circuit; a digital power amplifier circuit that generates an amplified digital signal by performing power amplification of the modulated signal; a low pass filter that generates the drive signal applied to the capacitive load by smoothing the amplified digital signal; an analog compensation circuit that performs a predetermined analog compensation process for the drive signal applied to the capacitive load such that the gain characteristics in a frequency band included in the drive signal become flat; and a digital conversion circuit that converts an output of the analog compensation circuit into a digital signal and supplies the converted digital signal to the digital arithmetic circuit as a digital compensation signal.

According to the above-described capacitive load driving circuit, a modulated signal is generated by performing pulse modulation of a drive waveform signal that is a reference for a drive signal to be applied to a capacitive load, and the drive signal is generated by performing power amplification of the acquired modulated signal and then smoothing the power-amplified modulated signal. Then, negative feedback of the drive signal applied to the capacitive load is applied to the drive waveform signal that is the reference for the drive signal. At this time, a predetermined analog compensation process for smoothing the gain characteristics in a frequency band included in the drive signal is performed for the drive signal, then the acquired signal is converted into a digital signal, and negative feedback of the digital signal is applied to the drive waveform signal.

Accordingly, the compensation for smoothing the gain characteristics in the frequency band of the drive signal is performed for the drive signal applied to the capacitive load, and negative feedback of the compensated driving signal is applied, whereby the resonance characteristics due to the LC circuit of the low pass filter can be suppressed. In addition, the power amplification is performed for the pulse-modulated signal, and accordingly, extra power is not consumed at the time of amplifying the power, and the size of the circuit substrate can be configured to be small. Furthermore, although the negative feedback of the drive signal or the modulation for forming a modulated signal is performed in the form of a digital signal, compensation for the drive signal when the negative feedback of the drive signal is applied is performed by an analog circuit, and accordingly, the delay time required for the negative feedback can be short. As a result, regardless of the negative feedback of the drive signal, even in a case where the frequency component of the drive signal is set to be high up to several hundreds of kHz, a stable drive signal can be output.

In the above-described capacitive load driving circuit, the digital arithmetic circuit used for applying the negative feedback of the digital compensation signal to the drive waveform signal may be configured by a subtraction circuit.

In the case of the subtraction circuit, digital calculation can be performed in a speedy manner so as to shorten the delay time at the time of the negative feedback, whereby drive signal can be output stably.

In the above-described capacitive load driving circuit, as analog compensation for the drive signal applied to the capacitive load, phase-leading compensation may be performed.

Since the drive signal applied to the capacitive load is a voltage waveform smoothed by the low pass filter, the drive signal is a voltage waveform of which phase lags with respect to that of the drive waveform signal that is used as the reference. Accordingly, in a case where negative feedback is performed after performing phase-leading compensation when the negative feedback of the drive signal is applied, the occurrence of a resonance phenomenon due to the negative feedback can be suppressed, whereby the drive signal can be avoided from being unstable.

In the above-described capacitive load driving circuit that performs the phase-leading compensation for the drive signal, the following configurations may be employed. First, a first analog circuit used for performing the phase-leading compensation and a second analog circuit that divides a voltage of the drive signal at a predetermined voltage-dividing ratio are disposed to be parallel to each other. It may be configured such that the drive signal is guided to the first analog circuit and the second analog circuit, an analog signal acquired by composing an output of the first analog circuit and an output of the second analog circuit is converted into a digital signal, and then, negative feedback is applied to the drive waveform signal.

In such a case, the effect of applying the negative feedback after performing the phase-leading compensation for the drive signal and the effect of dividing the voltage of the drive signal and applying the negative feedback can be acquired. Accordingly, even in a case where the magnitude of the capacitive component (or an inductive component) of the capacitive load varies, a power supply voltage varies at the time of amplifying the modulated signal, unbalance in various elements configuring the capacitive load driving circuit occurs, or the like, it is possible to suppress the occurrence of distortion in the drive signal. In addition, since the composed analog signal is converted into a digital signal, the capacitive load driving circuit can be realized by using only one A/D converter.

In an liquid ejecting apparatus including: an actuator that is used for ejecting liquid; and a capacitive load driving circuit that generates a drive signal used for driving the actuator, anyone of the above-described capacitive load driving circuit may be mounted.

In such a case, even in a case where the magnitude of the capacitive component or the magnitude of the inductive component of the actuator changes, a drive signal that is not influenced by such a change can be applied to the actuator, and accordingly, liquid can be appropriately ejected.

BRIEF DESCRIPTION OF THE DRAWINGS

The invention will be described with reference to the accompanying drawings, wherein like numbers reference like elements.

FIGS. 6A to 6D are explanatory diagrams illustrating the operation of the capacitive load driving circuit according to the first embodiment.

FIGS. 11A to 11D are explanatory diagrams illustrating the operation of the capacitive load driving circuit according to the second embodiment.

DESCRIPTION OF EXEMPLARY EMBODIMENTS

Hereinafter, in order to clarify the content of the invention described above, embodiments will be described in the following order.

A. First Embodiment

A-1. Apparatus Configuration

A-2. Circuit Configuration of Capacitive Load Driving Circuit

A-3. Operation of Capacitive Load Driving Circuit

B. Second Embodiment

C. Modified Examples

C-1. First Modified Example

C-2. Second Modified Example

C-3. Third Modified Example

A. FIRST EMBODIMENT

A-1. Apparatus Configuration

Figure 1:
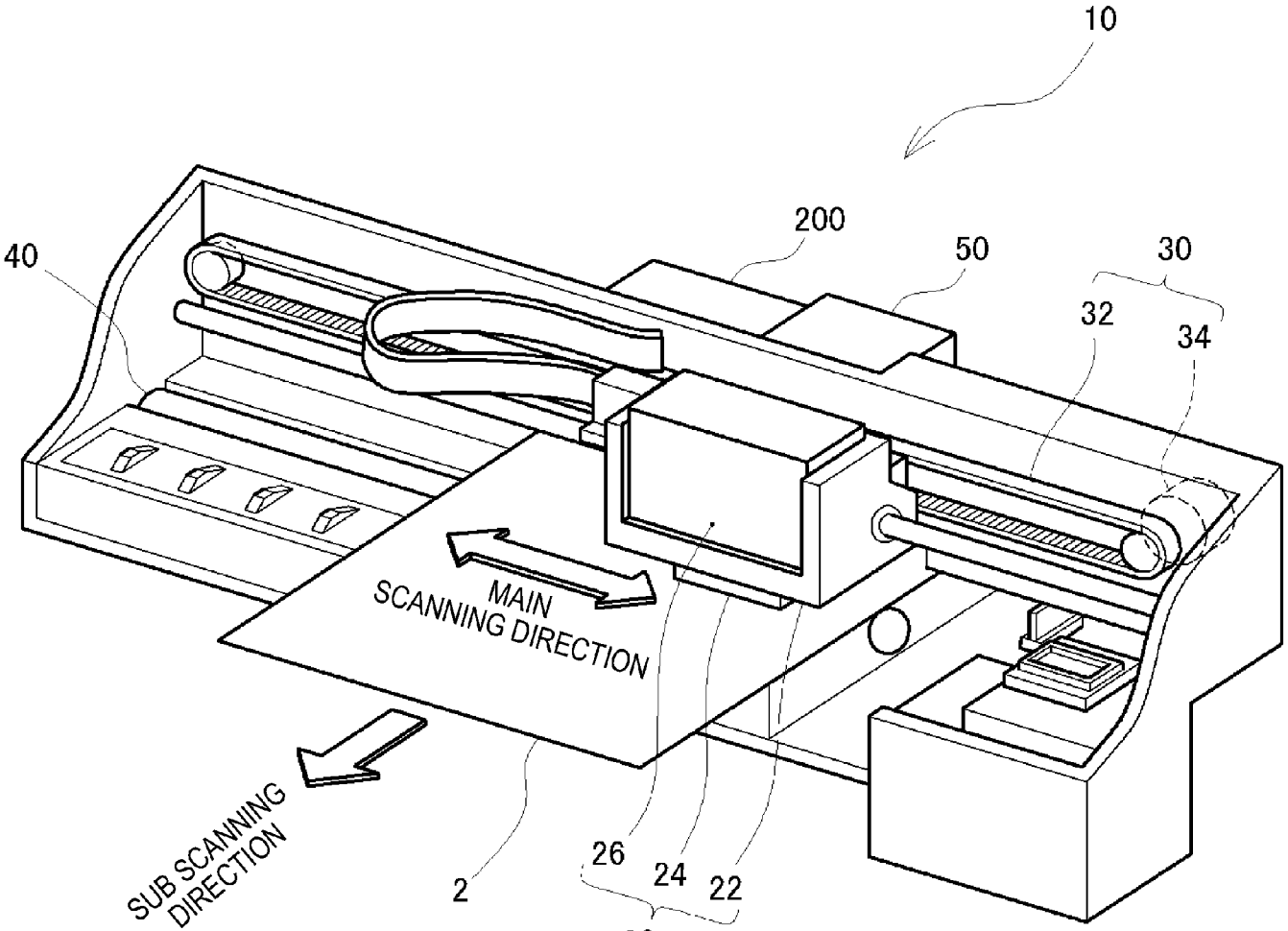
FIG. 1 is an explanatory diagram illustrating an example of an ink jet printer in which a capacitive load driving circuit according to an embodiment is mounted.

FIG. 1 is an explanatory diagram illustrating an example of an ink jet printer 10 in which a capacitive load driving circuit according to an embodiment is mounted. The ink jet printer 10 includes: a carriage 20 that forms ink dots on a printing medium 2 while reciprocating in the main scanning direction; a driving mechanism 30 that allows the carriage 20 to reciprocate; a platen roller 40 that is used for feeding the printing medium 2; and the like. In the carriage 20, an ink cartridge 26 that houses ink, a carriage case 22 in which the ink cartridge 26 is mounted, an ejection head 24 that is installed to the bottom side (the side facing the printing medium 2) of the carriage case 22 and ejects ink, and the like are disposed. The carriage 20 guides ink located inside the ink cartridge 26 to the ejection head 24, and ejects ink from the ejection head 24 onto the printing medium 2, thereby printing an image.

The driving mechanism 30 that allows the carriage 20 to reciprocate is configured by a timing belt 32 that is longitudinally installed by pulleys, a step motor 34 that drives the timing belt 32 through the pulleys, and the like. One portion of the timing belt 32 is fixed to the carriage case 22, and, by driving the timing belt 32, the carriage case 22 can reciprocate. The platen roller 40 configures a sheet feeding mechanism that feeds the printing medium 2 together with a driving motor and a gear mechanism that are not shown in the figure and can feed the printing medium 2 in the sub scanning direction by a predetermined amount each time.

In the inkjet printer 10, a printer control circuit 50 that controls the overall operation and a capacitive load driving circuit 200 used for driving the ejection head 24 are installed as well. The printer control circuit 50 controls the overall operation of the capacitive load driving circuit 200, the driving mechanism 30, the sheet feeding mechanism, and the like for ejecting ink by driving the ejection head 24 while feeding the printing medium 2.

Figure 2:
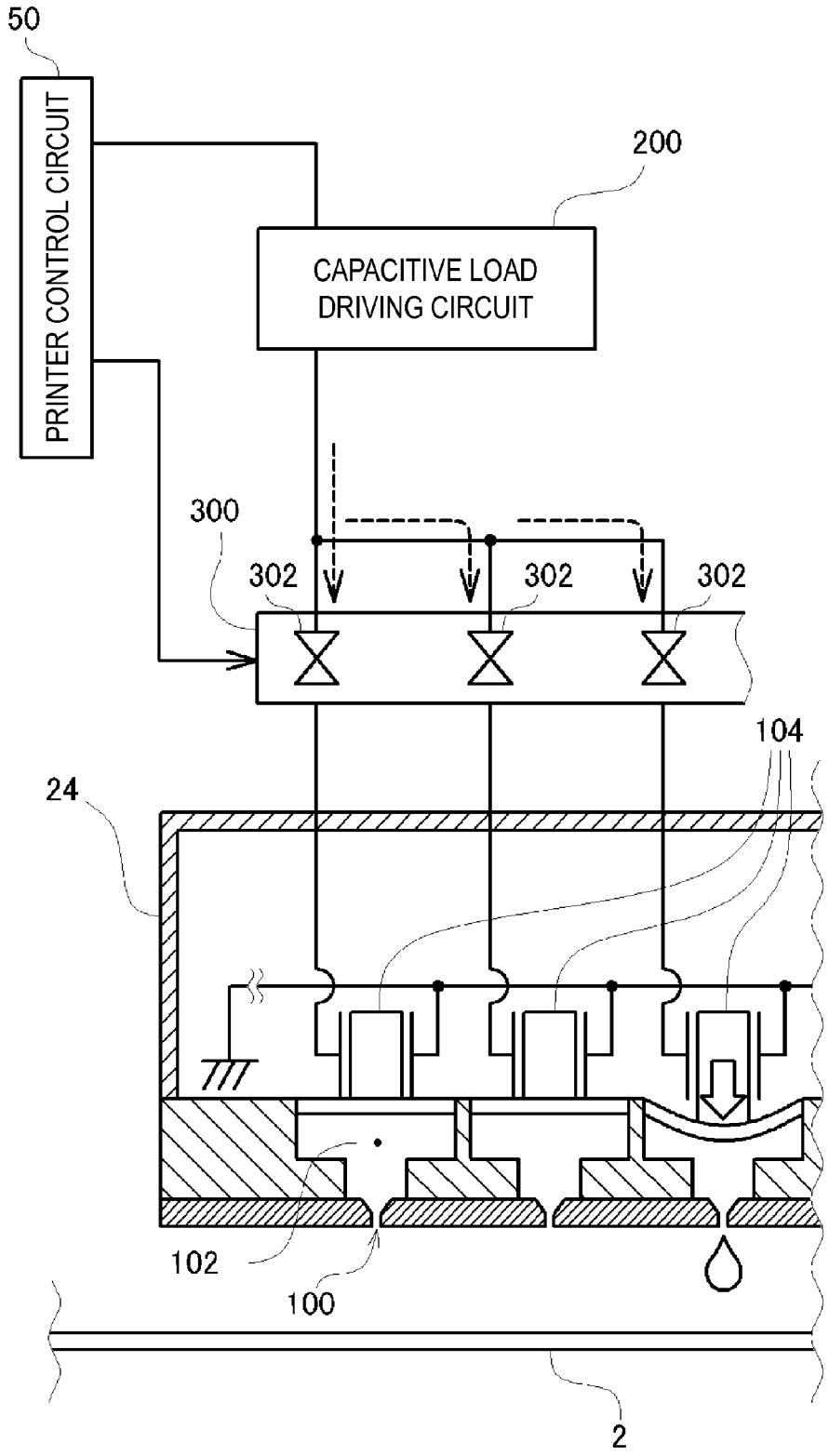
FIG. 2 is an explanatory diagram illustrating the appearance in which the capacitive load driving circuit drives an ejection head under the control of a printer control circuit.

FIG. 2 is an explanatory diagram illustrating the appearance in which the capacitive load driving circuit 200 drives the ejection head 24 under the control of the printer control circuit 50. First, the internal structure of the ejection head 24 will be briefly described. As shown in the figure, on the bottom (a face facing the printing medium 2) of the ejection head 24, a plurality of ejection openings 100 that eject ink droplets are disposed. Each ejection opening 100 is connected to each ink chamber 102, and ink supplied from the ink cartridge 26 is filled in the ink chamber 102. On each ink chamber 102, a piezoelectric device 104 is disposed, and, by applying a voltage to the piezoelectric device 104, the piezoelectric device is transformed so as to press the ink chamber 102, and accordingly, ink is ejected from the ejection opening 100. An amount of transformation of the piezoelectric device 104 changes in accordance with a value of the voltage applied thereto. Accordingly, by applying an appropriate voltage waveform to the piezoelectric device 104 so as to control an amount of transformation of the ink chamber 102 and a timing, ink of an appropriate amount can be ejected at appropriate timing.

The voltage waveform (drive signal) applied to the piezoelectric device 104 is generated by the capacitive load driving circuit 200 under the control of the printer control circuit 50. The generated drive signal is supplied to the piezoelectric device 104 through a gate unit 300. The gate unit 300 is a circuit unit in which a plurality of gate devices 302 are connected in parallel. Each gate device 302 can be individually in a conductive state or a cut-off state under the control of the printer control circuit 50. Accordingly, the drive signal output from the capacitive load driving circuit 200 passes only the gate device 302 that is set to be in the conductive state in advance by the printer control circuit 50 and is applied to the corresponding piezoelectric device 104, and ink is ejected from the ejection opening.

A-2. Circuit Configuration of Capacitive Load Driving Circuit

Figure 3:
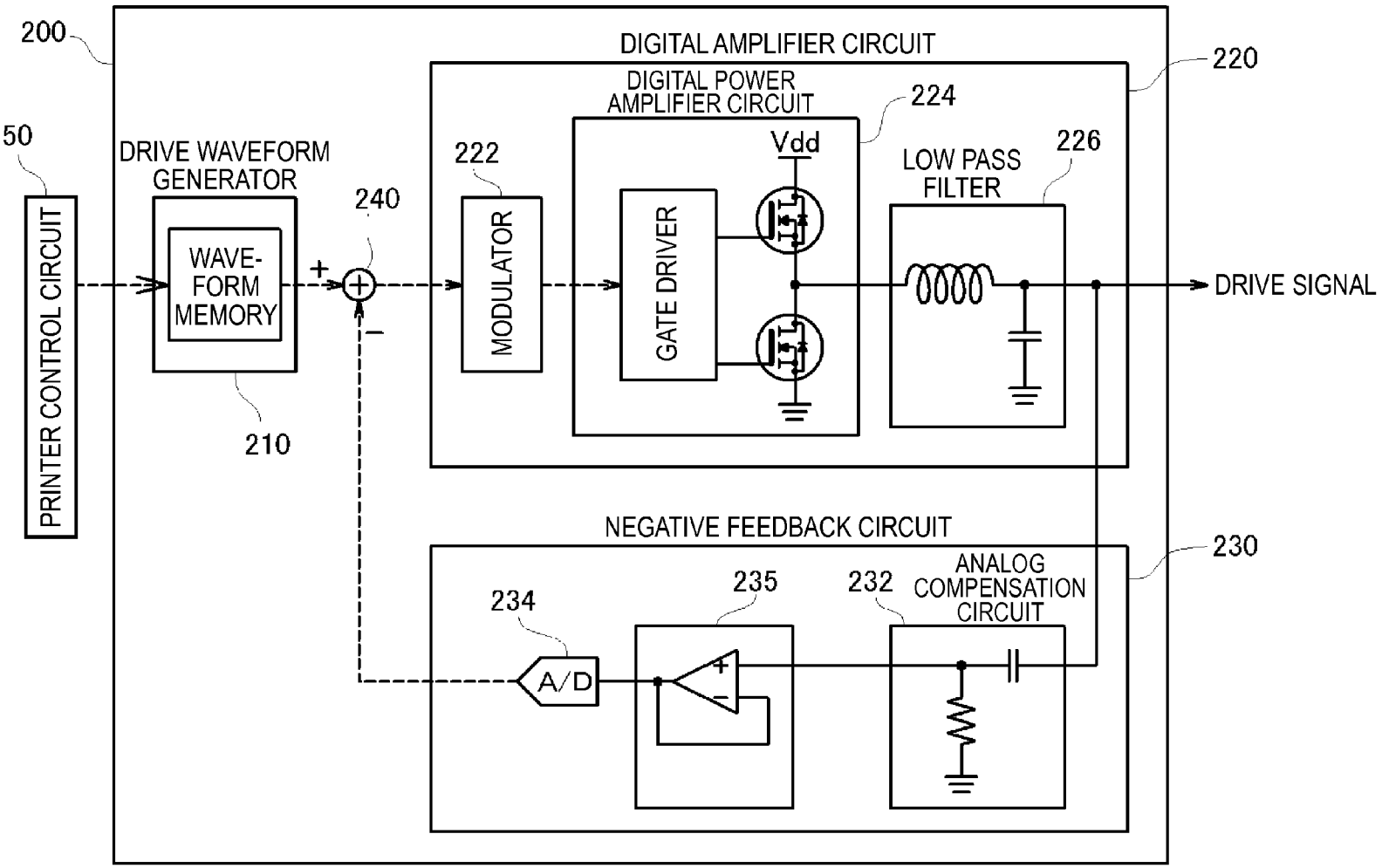
FIG. 3 is an explanatory diagram illustrating a detailed configuration of a capacitive load driving circuit according to a first embodiment.

FIG. 3 is an explanatory diagram illustrating a detailed configuration of a capacitive load driving circuit 200 according to a first embodiment. As shown in the figure, the capacitive load driving circuit 200 is configured by: a drive waveform generator 210 that outputs a drive waveform signal that is used as a reference for the drive signal; a digital amplifier circuit 220 that generates an analog drive signal by amplifying the drive waveform signal; a negative feedback circuit 230 that is used for applying negative feedback of the analog drive signal to the digital amplifier circuit 220, a digital calculator 240, and the like. The digital amplifier circuit 220 is configured by: a modulator 222 that performs pulse modulation of the drive waveform signal and outputs a modulated signal; a digital power amplifier circuit 224 that amplifies the power of the modulated signal; a low pass filter 226 that is used for generating a drive signal by eliminating a high frequency component of the amplified modulated signal; and the like. The negative feedback circuit 230 is configured by an analog compensation circuit 232 that adds predetermined compensation so as to enhance the characteristics of the drive signal; an A/D converter 234 that converts the compensated drive signal into a digital signal; an arithmetic amplifier circuit 235 that changes an input impedance of the A/D converter 234; and the like. Broken-line arrows shown in FIG. 3 represent the transfer of signals in the form of a digital signal, and a solid-line arrow represents the transfer of a signal in the form of an analog signal.

Figure 4:
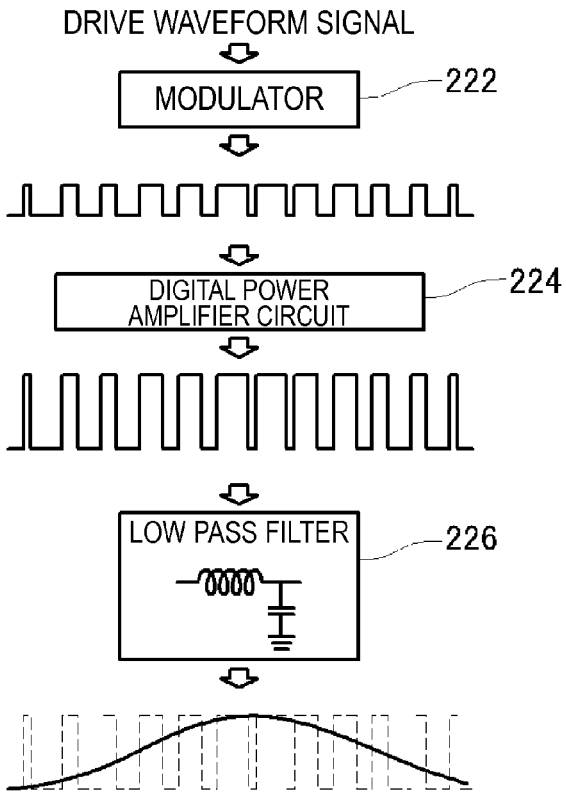
FIG. 4 is an explanatory diagram illustrating an overview of an operation of generating a drive signal by using a digital amplifier circuit.

FIG. 4 is an explanatory diagram illustrating an overview of an operation of generating the drive signal by using the digital amplifier circuit 220. When receiving the drive waveform signal from the drive waveform generator 210, the modulator 222 arranged inside the digital amplifier circuit 220 converts the drive waveform signal into a modulated signal. At this time, the modulator 222 modulates the drive waveform signal into a modulated signal of which the pulse width is modulated such that the width of the individual pulse is large in a case where a gray scale value of the drive waveform signal is large and the width of the individual pulse is small in a case where the gray scale value is small. Here, although the modulator 222 is described as a pulse-width modulator that modulates the pulse width in accordance with the gray scale value of the drive waveform signal, the modulation form is not limited thereto. For example, the modulator 222 may be a pulse-density modulator that modulates the density of the pulse in accordance with the gray scale value of the drive waveform signal without changing the pulse width.

Subsequently, the acquired modulated signal is supplied to the digital power amplifier circuit 224 so as to amplify the power thereof. The power of the modulated signal can be easily amplified by using a gate driver that drives push-pull connected switching devices (MOSFETs or the like), a power supply, and a switching device. In the example shown in FIG. 4, a voltage of the modulated signal is amplified by the digital power amplifier circuit 224. At this time, the modulated signal of which the power is amplified as described above is supplied to the low pass filter 226. Accordingly, an analog drive signal can be acquired in which a portion modulated into a large pulse width has a high voltage value, and a portion modulated into a small pulse width has a low voltage value. The low pass filter 226 can be simply realized by combining a coil and a capacitor.

When the drive signal is generated as described above, inside the digital power amplifier circuit 224, power is connected or cut off by using only the switching device, extra power is not consumed for amplifying the power. In addition, the low pass filter 226 can be configured by components such as a coil and a capacitor that do not consume power. Accordingly, the drive signal can be generated with scarcely consuming power.

Figure 5:
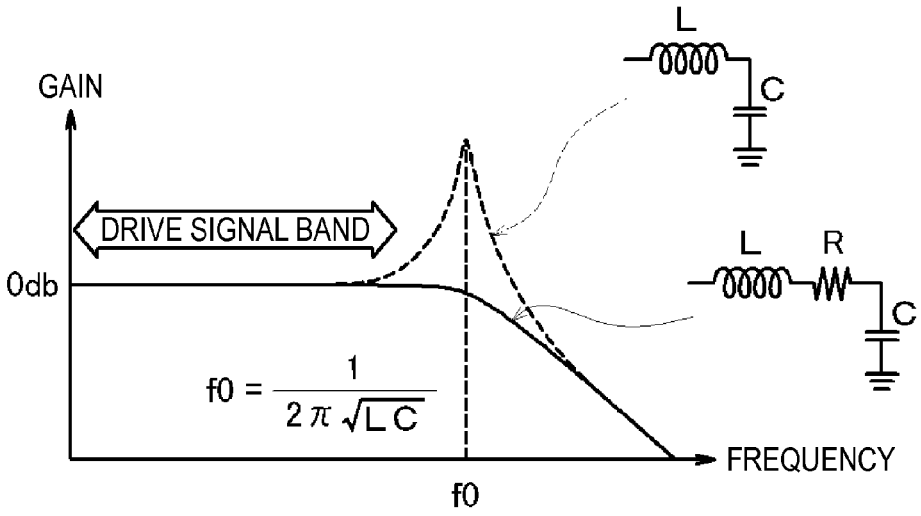
FIG. 5 is an explanatory diagram illustrating the reason for the occurrence of a distortion in the drive signal in a case where a low pass filter is configured by an LC circuit.

Here, the low pass filter 226 that is configured by the coil and the capacitor is formed as one type of a resonance circuit. FIG. 5 is an explanatory diagram illustrating the frequency characteristics of this resonance circuit. As denoted by thin broken lines in FIG. 5, assuming that the inductance component of the coil of the low pass filter 226 is L, and the capacitance component of the capacitor is C, a resonance frequency f0 is acquired by using a calculation equation shown in FIG. 5. Accordingly, in a case where a waveform of a frequency component that is close to the resonance frequency determined by the magnitude (impedance L) of the inductance component of the coil and the magnitude (capacitance C) of the capacitance component of the capacitor is input, resonance occurs, whereby a waveform having a remarkably large amplitude is output.

As denoted by a solid line shown in FIG. 5, in a case where a resistor R is inserted into the low pass filter 226, although the influence of the distortion due to resonance can be suppressed, all the currents flow through the resistor R, whereby power is consumed much. This is against the purpose of converting a drive signal into a modulated signal once and then amplifying the power thereof for suppressing the power consumption.

Thus, in the capacitive load driving circuit 200 according to this embodiment, in order to suppress the resonance characteristics near the resonance frequency f0, as shown in FIG. 3, the negative feedback circuit 230 is arranged so as to apply negative feedback of the drive signal output to the piezoelectric device 104. In addition, in order to avoid the degradation of stability of the control system due to the negative feedback of the output drive signal, a configuration is employed in which the negative feedback circuit 230 is configured by the analog compensation circuit 232, the A/D converter 234, and the like, and, after predetermined compensation is added to the analog drive signal, the resultant analog drive signal is converted into digital data and is applied to the digital amplifier circuit 220 as negative feedback. Accordingly, the resonance characteristics of the low pass filter can be suppressed, and compensation is added in the analog compensation circuit 232 without a delay, and the negative feedback is performed by the digital calculator 240 through simple calculations such as addition and subtraction, whereby a total delay time can be suppressed to be short. As a result, the capacitive load driving circuit 200 that stably operates even in a case where the frequency component of the drive signal is set to be high up to several hundreds of kHz can be realized. In addition, it is apparent that power amplification is performed in the state of a modulated signal, the power efficiency is high, and the size of the circuit substrate can be decreased. Hereinafter, the operation of the capacitive load driving circuit 200 according to this embodiment will be described.

A-3. Operation of Capacitive Load Driving Circuit

FIGS. 6A to 6D are explanatory diagrams illustrating the operation of the capacitive load driving circuit 200 according to the first embodiment. FIG. 6A shows a block diagram of the capacitive load driving circuit 200 according to the first embodiment shown in FIG. 3. In FIG. 6A, the drive waveform signal output by the drive waveform generator 210 corresponds to an input of the control system and is denoted by "Vin", and the drive signal output to the piezoelectric device 104 corresponds to an output of the control system and is denoted by "Vout". The digital power amplifier circuit 224 is represented as a gain element that outputs G times the input, the low pass filter 226 is represented as a low pass filter that has a transfer function Lf(s), and the analog compensation circuit 232 is represented as an element that has a transfer function β(s).

Here, Lf(s) or β(s) illustrates that they are represented in a frequency domain. In other words, the response of the low pass filter 226 or the analog compensation circuit 232 is originally described by a linear differential equation having time as its variable. In a case where the response thereof is converted to have a frequency as its variable through a Laplas transformation, the linear differential equation can be represented by a simple transfer function. The response of a system acquired by combining a plurality of elements such as the low pass filter 226 and the analog compensation circuit 232 can be represented as addition, subtraction, or multiplication of transfer functions of the elements in the frequency domain. Accordingly, it is simpler to convert differential equations into transfer functions in the frequency domain through the Laplas transformation and then check the frequency response than to solve the differential equation in a time domain. Lf(s) or β(s) represents a transfer function in the frequency domain that is acquired by transforming the differential equation representing the time response of the low pass filter 226 or the analog compensation circuit 232 through the Laplas transformation.

The operation of the capacitive load driving circuit 200 according to the first embodiment shown in FIG. 3 can be described by the transfer function of the entire control system that is represented by the block diagram shown in FIG. 6A. In order to acquire the transfer function of the entire control system, the transfer function of each element may be acquired.

In FIG. 6B, the transfer function Lf(s) of the low pass filter 226 is represented. Assuming that the magnitude of the inductance component of the coil is L, and the magnitude of the capacitance component of the capacitor is C, the transfer function Lf(s) of the low pass filter 226 is given as $1/(s^2LC+1)$ as shown in FIG. 6B. The low pass filter 226 has a characteristic of allowing a phase to lag, and, in a case where a waveform having a lagging phase is applied as negative feedback, there is a concern that the control system may be unstable. Thus, in order to allow the lagging phase to lead, the analog compensation circuit 232 performs compensation for allowing the phase to lead.

In FIG. 6C, the transfer function β(s) of the analog compensation circuit 232 is represented. As shown in the figure, the analog compensation circuit 232 can be configured by combining a capacitor and a resistor. Assuming that the magnitude of the capacitance component of the capacitor is C, and the magnitude of the resistor is R, the transfer function β(s) of the analog compensation circuit 232, as shown in the figure, is given as $1/(1+1/CRs)$.

Accordingly, as represented in the block diagram shown in FIG. 6A, it can be understood that a value acquired by multiplying a value acquired by subtracting a value that is acquired by multiplying the output Vout(S) of the system by the transfer function β(s) of the compensation circuit 232 from the input Vin(s) of the system by the gain G and the transfer function Lf(s) of the low pass filter 226 is the output Vout(s) of the system. When Vout(s)/Vin(s) is acquired by rearranging the relation equation, as represented in FIG. 6D, a transfer function H(s) of the entire control system is $H(s)=1/(\beta(s)+1/GLf(s))$.

Figure 7:
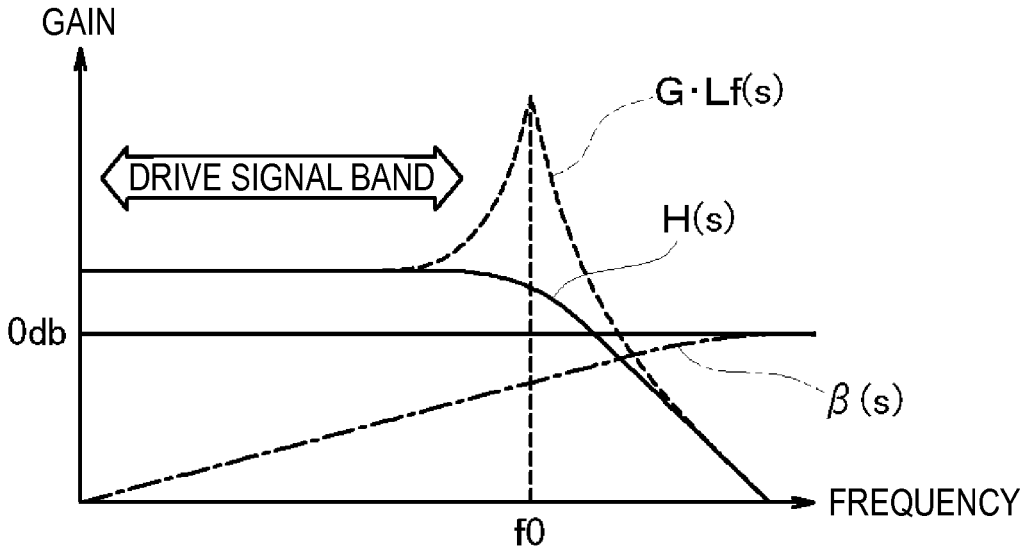
FIG. 7 is an explanatory diagram illustrating a gain characteristic of a transfer function of the capacitive load driving circuit according to the first embodiment.

FIG. 7 represents the frequency response relating to the gain characteristics of the transfer function acquired as described above, and a solid line shown in the figure represents the frequency response of the transfer function H(s), and a thin dashed-dotted line represents the frequency response of the transfer function β(s) of a phase-leading compensation circuit. As a reference, in FIG. 7, the gain characteristics of a transfer function G·Lf(s) in a case where the negative feedback of the drive signal is not applied (thus, in a case where the phase-leading compensation is not performed) is denoted by a broken line. As shown in the figure, by performing the phase-leading compensation for a drive signal and applying the negative feedback, a peak around the resonance frequency f0 can be sufficiently suppressed while maintaining the gain in the drive signal band. Differently from a case where the resistor R is inserted into the low pass filter 226, only the analog compensation circuit as shown in FIG. 6C is added, and accordingly, power consumption is not high.

It is apparent that, in a case where only an element such as the low pass filter 226 that is used for finally converting a digital signal into an analog signal is left, and all the other elements are digitalized, there is no influence of the variation of the capacitive load, and the power consumption can be suppressed. For example, even in a case where a drive signal output to the piezoelectric device 104 is converted into an analog signal by using the A/D converter, and the analog compensation circuit 232 is realized by a digital filter, similar advantages can be acquired. However, practically, according to this method, it is difficult to generate a stable drive signal. Hereinafter, this point will be described.

First, a case may be considered in which a differential filter is mounted so as to realize the phase-leading compensation in a digital manner. However, in such a case, the differential filter can be easily influenced by the effect of a noise, and it is difficult to generate a stable drive signal due to negative feedback of the noise. In addition, a method may be considered in which the digital filter (the low pass filter) used for eliminating a noise is inserted to a previous stage of the differential filter. However, in a case where the low pass filter is configured by using the digital filter, a delay time is long. Other than the above-described cases, as in JP-A-2010-46989, in a case where a state stabilizing mechanism that estimates the magnitude of a current flowing through the piezoelectric device based on a digital drive signal and a digital load voltage signal is configured, the delay time is long. In a case where the delay time is long, the stability of the control system is remarkably degraded.

In contrast to this, in the capacitive load driving circuit 200 according to the first embodiment shown in FIGS. 6A to 6D, the analog compensation circuit 232 is realized by an analog circuit. Accordingly, a total delay time is determined based on delay times occurring in the A/D converter 234 disposed inside the negative feedback circuit 230, the digital calculator 240 (actually, a subtraction circuit) used for the negative feedback of a digital signal, the modulator 222, and the digital power amplifier circuit 224. However, since the delay time due to each element is short, the total delay time can be sufficiently short as about 200 nanoseconds at most. For such a short delay time, as illustrated below, the control system can operate sufficiently stably.

First, the stability of the control system is determined based on the open-loop transfer function Ho(s). In order to allow the control system to stably operate, in a frequency range in which the gain of the open-loop transfer function Ho(s) is equal to or more than 0 dB, the delay of the phase may not be more than 180 degrees (the phase may not be equal to or less than −180 degrees). The open-loop transfer function Ho(S) of the control system illustrated in FIGS. 6A to 6D is $Ho(s)=G\cdot Lf(s)\cdot\beta(s)\cdot\exp(-s\tau)$. This corresponds to a transfer function acquired by multiplying the transfer function G·Lf (s) of a case where no negative feedback is applied by the transfer function β(s) of the phase-leading circuit and a transfer function $\exp(-s\tau)$ of the delay time element in a case where a delay time of the entire control system is "τ". Accordingly, the frequency responses of the gain and the phase of Ho(s) are as shown in FIGS. 8A to 8D.

Figure 8A:
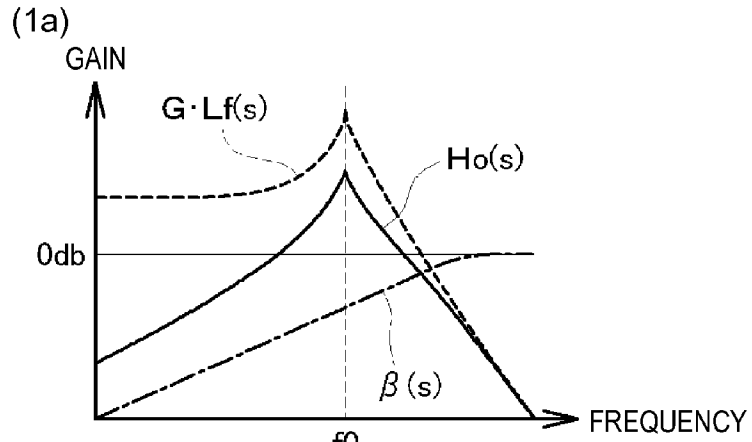
FIGS. 8A to 8D are explanatory diagrams illustrating frequency responses of an open-loop transfer function Ho(s) of the capacitive load driving circuit according to the first embodiment.
Figure 8B:
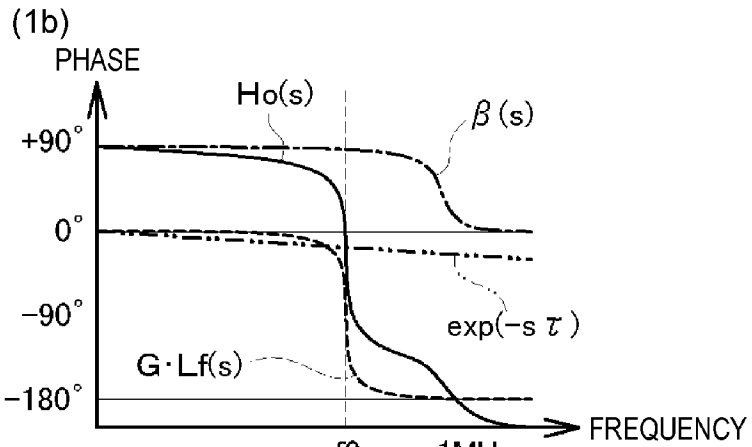
Figure 8C:
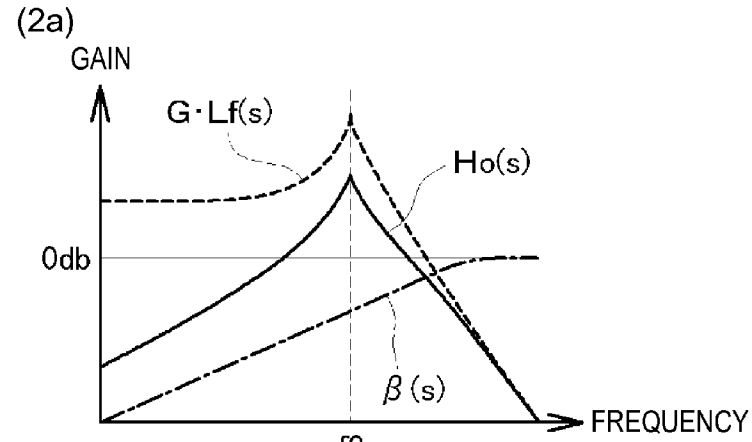
Figure 8D:
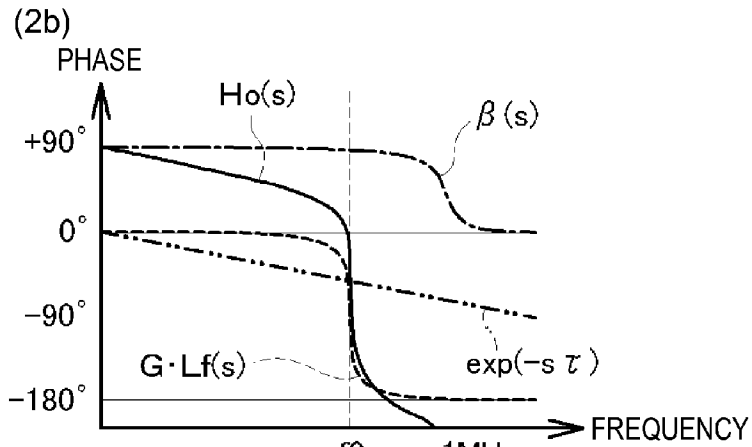

FIGS. 8A to 8D are explanatory diagrams illustrating the frequency responses of the open-loop transfer function Ho(s) of the capacitive load driving circuit 200 according to the first embodiment. FIGS. 8A and 8B illustrate the frequency response of the gain and the frequency response of the phase in a case where the delay time τ is short, and FIGS. 8C and 8D illustrate the frequency response of the gain and the frequency response of the phase in a case where the delay time τ is long. Solid lines shown in the figures illustrate the frequency responses of the open-loop transfer functions Ho(s), thin broken lines shown in the figures illustrate the frequency responses of the transfer functions in a case where no negative feedback is applied, thin dashed-dotted lines shown in the figures illustrate the frequency responses of the transfer functions β(s) of the phase-leading compensation circuit, and thin dashed-two dotted lines illustrates the delay times. As denoted by thin broken lines in the figures, although the phase of the transfer function in a case where no negative feedback is applied lags up to −180 degrees at most, the phase-leading compensation of the transfer function β(s) is performed, and accordingly, there is a margin corresponding to 90 degrees. As a result, as a condition that the system operates stably in the frequency range in which the gain of Ho(s) is equal to or more than 0 dB, −90 degrees<−τ·operating frequency f·360 degrees may be satisfied, in other words, a condition of "τ" operating frequency f<¼" may be satisfied. As described above, since the delay time τ of the capacitive load driving circuit 200 according to the first embodiment shown in FIGS. 6A to 6D is short as 200 nanoseconds (actually one hundred and several tens of nanoseconds) at most, as shown in FIG. 8B, the system can operate sufficiently stably even in a range of the operating frequency f up to 1 MHz. In contrast to this, in a case where, as the compensation circuit, the differential filter and the low pass filter used for eliminating a noise are digitally implemented or, as in JP-A-2010-46989, the state stabilizing mechanism, which estimates the magnitude of the current flowing through the piezoelectric device based on the digital drive signal and the digital load voltage signal, is digitally implemented, the delay time is long as several hundreds of nanoseconds to several microseconds. As a result, as shown in FIG. 8D, in a case where the operating frequency f is several hundreds of kHz, the above-described condition is not satisfied, and the control system can be easily unstable, whereby it is difficult to stably generate a drive signal.

As described above, in the capacitive load driving circuit 200 according to the first embodiment shown in FIGS. 6A to 6D, the phase-leading compensation is performed for the drive signal output from the low pass filter 226, and the compensated drive signal is configured as the negative feedback, whereby the gain characteristics near the resonance frequency can be suppressed. The phase-leading compensation is performed in an analog manner by using the analog compensation circuit 232. Accordingly, regardless of the negative feedback of the drive signal, the control system can be maintained stably, and, even in a case where the frequency component of the drive signal is set to be high up to several hundreds of kHz, a drive signal with high accuracy can be stably generated. In addition, the power amplification is performed in the stage of a modulated signal, the power consumption is suppressed whereby the size of the circuit substrate can be decreased. Furthermore, since a drive signal is input to the A/D converter 234 through the arithmetic amplifier circuit 235, the input impedance is lowered, and, as a result, the drive signal for which the phase-leading compensation is performed can be reliably converted into a digital signal without being influence by a noise and the like. In this embodiment, although the configuration of the arithmetic amplifier circuit 235 is formed as non-inverting amplification (voltage follower), the arithmetic amplifier circuit 235 may be configured as inverted amplification, and the digital calculator 240 may be configured by an addition circuit.

B. SECOND EMBODIMENT

In the capacitive load driving circuit 200 according to the first embodiment described above, by suppressing an increase in the gain near the resonance frequency of the low pass filter 226, the drive signal is prevented from being distorted. However, actually, in a case where the magnitude of the capacitive component (or inductive component) of the capacitive load remarkably increases, the frequency characteristics of the low pass filter change, and slight distortion in the drive signal appears.

Figure 9:
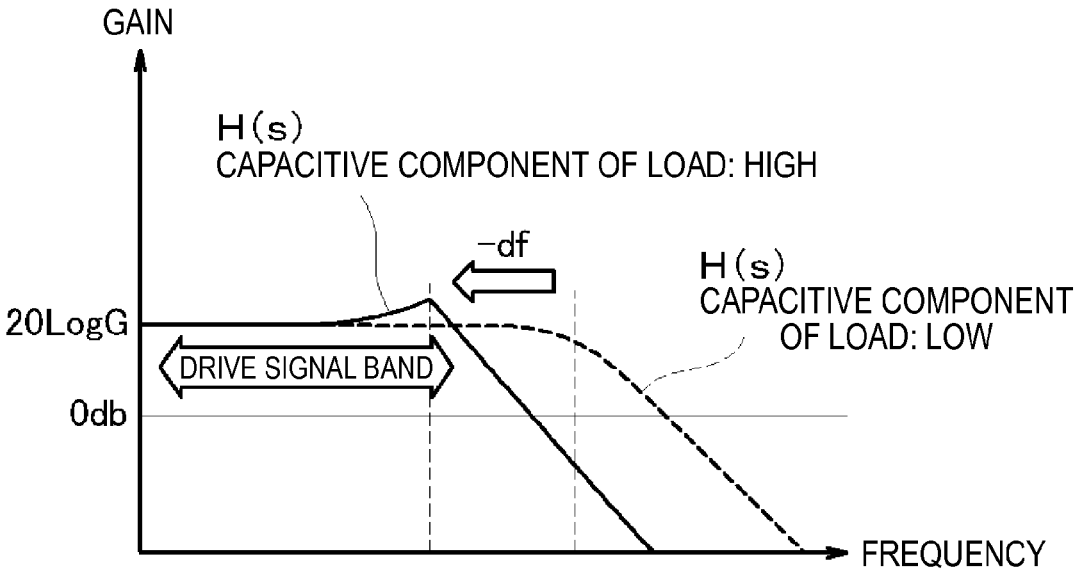
FIG. 9 is an explanatory diagram illustrating a change in the gain characteristic in accordance with a remarkable increase in a capacitive component of a capacitive load of the capacitive load driving circuit according to the first embodiment.

FIG. 9 is an explanatory diagram illustrating a change in the gain characteristics in accordance with a remarkable increase in the capacitive component of the capacitive load of the capacitive load driving circuit 200 according to the first embodiment. In the figure, characteristics denoted by a broken line are the gain characteristics before a remarkable increase in the capacitive component of the capacitive load, and characteristics denoted by a solid line in the figure are the gain characteristics in a case where the capacitive component of the capacitive load remarkably increases. Although represented in a slightly emphasized manner in FIG. 9, as the capacitive component of the capacitive load remarkably increases, the resonance frequency is lowered by "−df" so as to be close to the drive signal band, and an increase in the gain near the resonance frequency cannot be completely suppressed. As a result, the high frequency component of the drive signal is enhanced, slight distortion appears in the drive signal. However, by configuring the analog compensation circuit 232 of the above-described capacitive load driving circuit 200 according to the first embodiment as described below, such slight distortion of the waveform can be suppressed. In addition, in a case where the frequency component of the drive signal is set to be high up to several hundreds of kHz or there is external disturbance, the drive signal can be generated more stably. Here, a capacitive load driving circuit 250 according to a second embodiment will be described.

Figure 10:
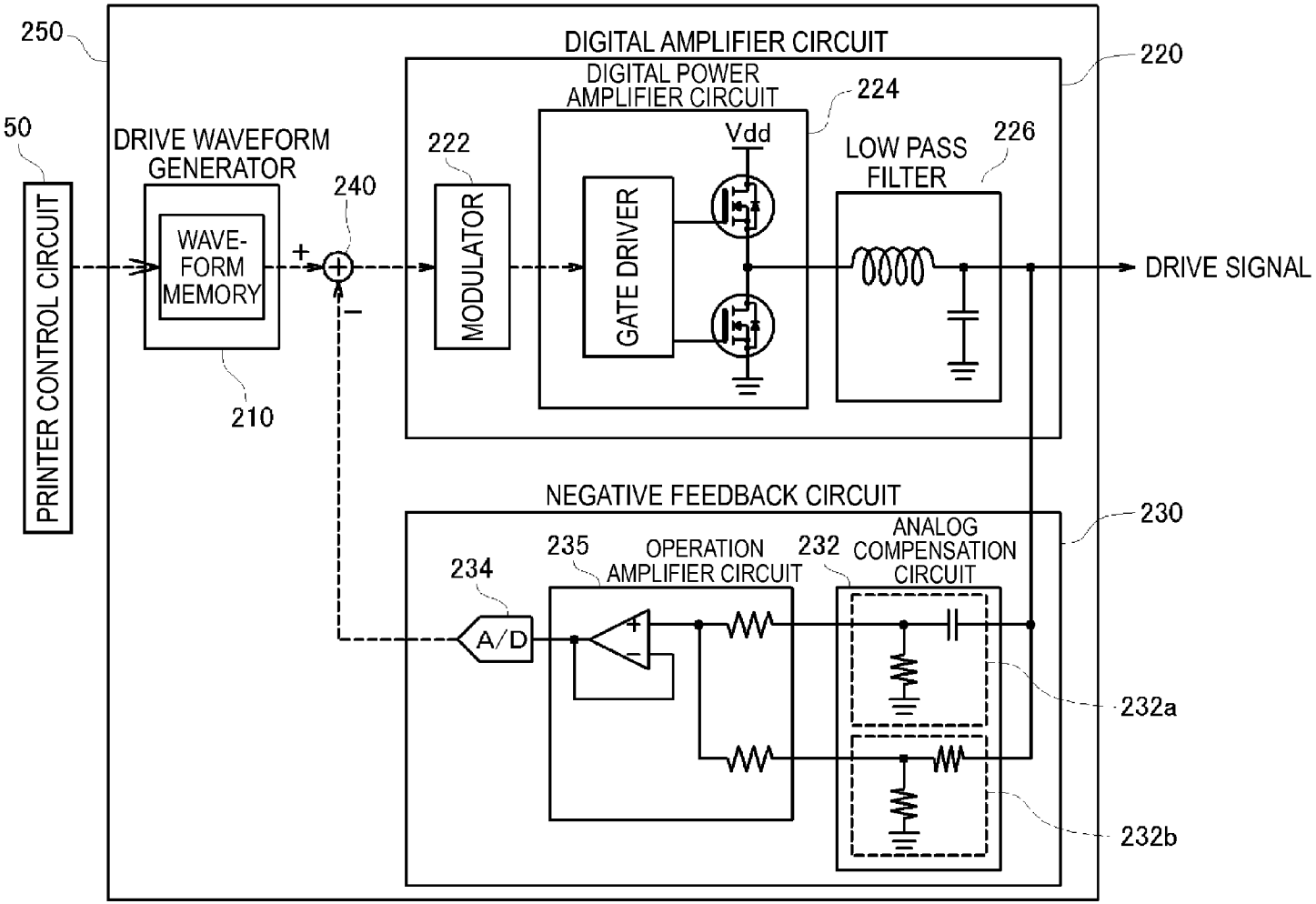
FIG. 10 is an explanatory diagram illustrating the configuration of a capacitive load driving circuit according to a second embodiment.

FIG. 10 is an explanatory diagram illustrating the configuration of the capacitive load driving circuit 250 according to the second embodiment. As is apparent from a comparison with the above-described capacitive load driving circuit 200 according to the first embodiment described with reference to FIG. 3, in the capacitive load driving circuit 250 according to the second embodiment, there are differences from the capacitive load driving circuit 200 that an analog compensation circuit 232 is changed, a value acquired by multiplying the drive waveform signal by a constant number is controlled as negative feedback. In the analog compensation circuit 232 according to the second embodiment, a configuration is formed in which a voltage-dividing circuit 232*b* is connected to a phase-leading compensation circuit 232*a* corresponding to the analog compensation circuit 232 according to the first embodiment in parallel. It is assumed that a voltage-dividing ratio of the voltage-dividing circuit 232*b* is α/G. Then, the constant number to be multiplied for the drive waveform signal is set to (α+1).

Now, the frequency response of a transfer function K(s) of the capacitive load driving circuit 250 according to the second embodiment in the drive signal band will be described. First, the phase-leading compensation circuit 232*a* according to the second embodiment is the same as the phase-leading compensation circuit 232 according to the first embodiment shown in FIG. 3, and the transfer function that is configured by the digital amplifier circuit 220 and the phase-leading compensation circuit 232*a* is H(s). As a result, the operation of the capacitive load driving circuit 250 according to the second embodiment shown in FIG. 10 can be described as the following block diagram.

FIGS. 11A to 11D are explanatory diagrams illustrating the operation of the capacitive load driving circuit 250 according to the second embodiment. FIG. 11A shows a block diagram of the capacitive load driving circuit 250 according to the second embodiment. An external disturbance element δ shown in the block diagram illustrates the effect of a variation in the magnitude of the capacitive component of the capacitive load, a variation in the gain G due to a variation in the power supply voltage at the time of amplifying a modulated signal, unbalances in various elements configuring the capacitive load driving circuit 250, and the like.

When a relation equation between an input Vin (corresponding to the drive waveform signal output by the drive waveform generator 210) of the control system and an output Vout (corresponding to the drive signal generated by the capacitive load driving circuit 250) of the control system is described based on such a block diagram, a relation equation as represented in FIG. 11B can be acquired. By arranging this equation with respect to Vin and δ, as shown in FIG. 11C, a relation equation that represents the influence of the signal component Vin and the external disturbance component δ on the output Vout is acquired. In addition, here, the drive signal band is focused, and the magnitude of the transfer function H(s) in this frequency range is almost "G". Accordingly, when the transfer function H(s) is substituted by "G" in the relation equation represented in FIG. 11C, finally, a relation equation represented in FIG. 11D can be acquired.

Figure 12A:
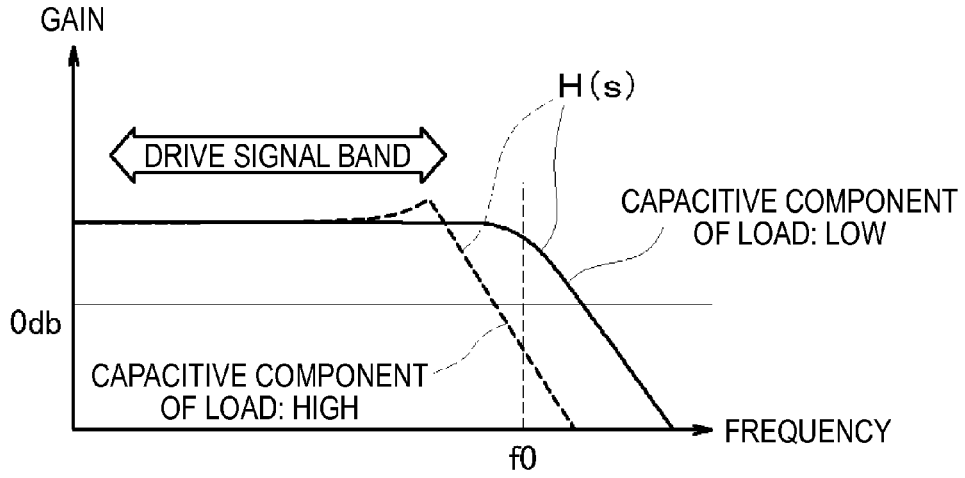
FIGS. 12A and 12B are explanatory diagrams illustrating the appearance in which a gain characteristic for a drive signal band can be maintained to be excellent by employing the capacitive load driving circuit according to the second embodiment.
Figure 12B:
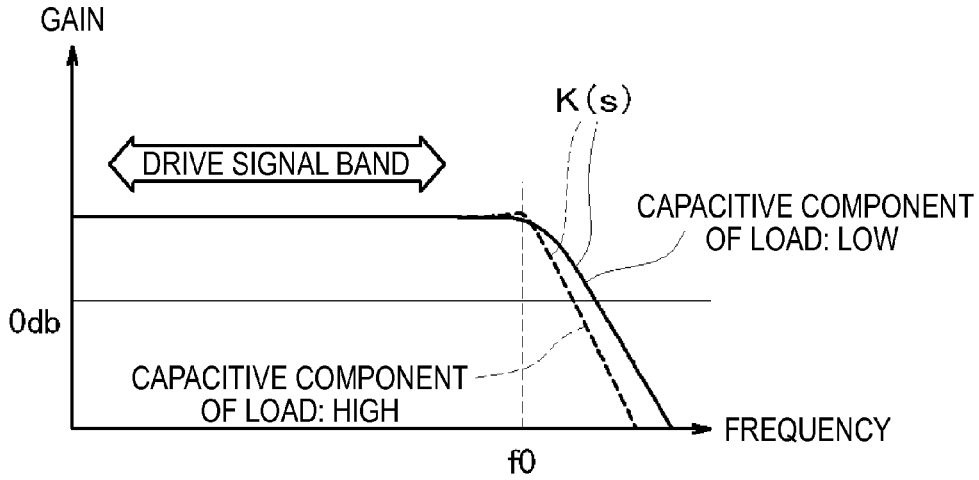

As is apparent from this relation equation, in the capacitive load driving circuit 250 according to the second embodiment, although the input Vin as the signal component is amplified by G times, the external disturbance component δ is suppressed to $1/(1+\alpha)$. Accordingly, a drive signal with high accuracy can be stably generated without being influenced by the magnitude of the capacitive component (or the inductive component) of the capacitive load, the power supply voltage at the time of amplifying a modulated signal, and the like. In the capacitive load driving circuit 250 according to the second embodiment, the reason for not directly inputting the input Vin but inputting the input after being multiplied by the constant $(\alpha+1)$ is that as signal component of the relation equation shown in FIG. 11C, in the condition of H(s)=G, the signal component becomes Vout=G·Vin. FIGS. 12A and 12B illustrate the appearances in which the gain characteristics in the drive signal band are maintained well without being influenced by the effect of the external disturbance such as a variation in the capacitive load by employing the capacitive load driving circuit 250 according to the second embodiment. When comparing the gain characteristics H(s) of the capacitive load driving circuit 200 according to the first embodiment shown in FIG. 12A and the gain characteristics K(s) of the capacitive load driving circuit 250 according to the second embodiment shown in FIG. 12B with each other, it can be understood that, by employing the capacitive load driving circuit 250 according to the second embodiment, the gain characteristics in the drive signal band are maintained well without being influenced by the external disturbance, and the gain characteristics in the high frequency band are improved. As a result, in the capacitive load driving circuit 250 according to the second embodiment, a drive signal having higher accuracy can be stably generated. It is apparent that, similarly to the first embodiment, the total delay time τ can be suppressed to be short, and accordingly, even in a case where the frequency component of the drive signal is set to be high up to several hundreds of kHZ, a drive signal having high accuracy can be stably generated. In addition, since the composed analog signal is converted into a digital signal, the capacitive load driving circuit can be realized by using only one A/D converter.

Differently from the capacitive load driving circuit 200 according to the first embodiment, in the capacitive load driving circuit 250 according to the second embodiment, the voltage-dividing circuit 232*b* configured by resistors is inserted into the inside of the analog compensation circuit 232 that configures the negative-feedback circuit 230. Accordingly, in the capacitive load driving circuit 250 according to the second embodiment, power corresponding to a current flowing through the resistors is consumed. However, since the arithmetic amplifier circuit 235 is inserted into the inside of the negative-feedback circuit 230, the voltage-dividing circuit 232*b* can be configured by using resistors having high resistance. Accordingly, the power consumption in the voltage-dividing circuit 232*b* can be suppressed so as to scarcely cause a problem.

C. MODIFIED EXAMPLES

Several modified examples of the above-described capacitive load driving circuit according to various embodiments can be considered. Hereinafter, such modified examples will be briefly described.

C-1. First Modified Example

In the above-described first or second embodiment, the capacitive load driven by applying a drive signal thereto is described as the piezoelectric device 104 disposed inside the ejection head 24. As described above, since the number of the piezoelectric devices 104 to be driven changes to a large extent during a printing process, the magnitude of the capacitive component of the capacitive load greatly changes. However, the capacitive load to be driven is not limited to the piezoelectric device 104 disposed inside the ejection head 24, and any capacitive load may be used as long as the magnitude of its capacitive component changes. For example, even in a case where a liquid pump that ejects liquid using a piezoelectric device is driven, the capacitive load driving circuit 200 according to the first embodiment or the capacitive load driving circuit 250 according to the second embodiment can be appropriately applied.

Figure 13:
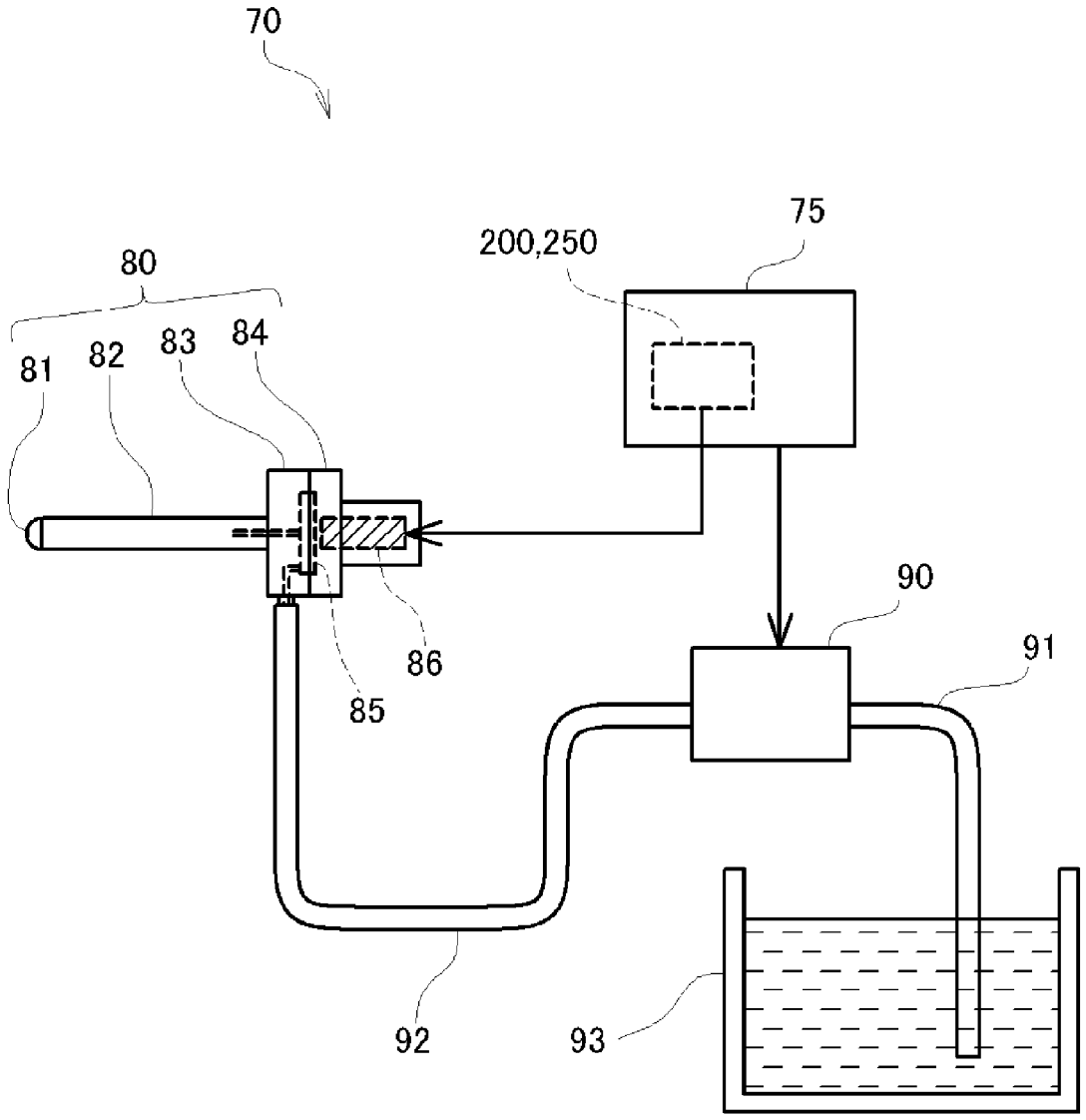
FIG. 13 is an explanatory diagram illustrating a schematic configuration of a liquid pump that ejects liquid by using a piezoelectric device.

FIG. 13 is an explanatory diagram illustrating a schematic configuration of a liquid pump 70 that ejects liquid by using a piezoelectric device. As shown in the figure, the liquid pump 70, when largely divided, is configured by: an ejection unit 80 that ejects liquid in a pulse shape; a supply pump 90 that supplies liquid to be ejected from the ejection unit 80 toward the ejection unit 80; a control unit 75 that controls the operation of the ejection unit 80 and the supply pump 90; and the like.

The ejection unit 80 has a structure in which an approximately rectangular front block 83 made of metal is overlapped with a rear block 84 made of the same metal and is fastened thereto by using screws. On a front face of the front block 83, a liquid passage tube 82 having a circular tube shape is uprightly installed, and an ejection nozzle 81 is inserted into a tip end of the liquid passage tube 82 so as to be attached thereto. On a face joining the front block 83 and the rear block 84, a liquid chamber 85 having a thin disk-shape is disposed, and the liquid chamber 85 is connected to the ejection nozzle 81 through the liquid passage tube 82. Inside the rear block 84, an actuator 86 that is configured by a piezoelectric device is disposed, and, by driving the actuator 86, the liquid chamber 85 is transformed, whereby the volume of the liquid chamber 85 can be changed.

After pumping up liquid through a tube 91 from a liquid tank 93 in which the liquid (water, a physiological salt solution, a liquid medicine, or the like) to be ejected is saved, the supply pump 90 supplies the liquid to the inside of the liquid chamber 85 of the ejection unit 80 through a tube 92. The operation of the supply pump 90 is controlled by the control unit 75. In addition, the capacitive load driving circuit 200 or 250 is built in the control unit 75, and, the control unit 75 drives the actuator 86 by supplying a drive signal generated by the capacitive load driving circuit 200 or 250 thereto, whereby the liquid having a pulse shape is ejected from the ejection nozzle 81 of the ejection unit 80.

Here, the ejection unit 80 is replaced with the ejection unit 80 having appropriate characteristics in accordance with the liquid to be ejected or the ejection form (the magnitude of the pulse, the repetition frequency of the pulse, the flow rate of ejection, or the like). In a case where the characteristics of the ejection unit 80 differ, the magnitude of the capacitive component of the actuator 86 (piezoelectric device) built thereto differs. Alternatively, in a case where the ejection unit 80 has an inductive component, in such a case, the magnitude of the inductive component differs.

Accordingly, in a case where the drive signal of the actuator 86 is generated by using the capacitive load driving circuit 200 according to the first embodiment or the capacitive load driving circuit 250 according to the second embodiment described above, even when the ejection unit 80 is replaced, a drive signal having high accuracy can be constantly output in a stable manner.

C-2. Second Modified Example

Figure 14:
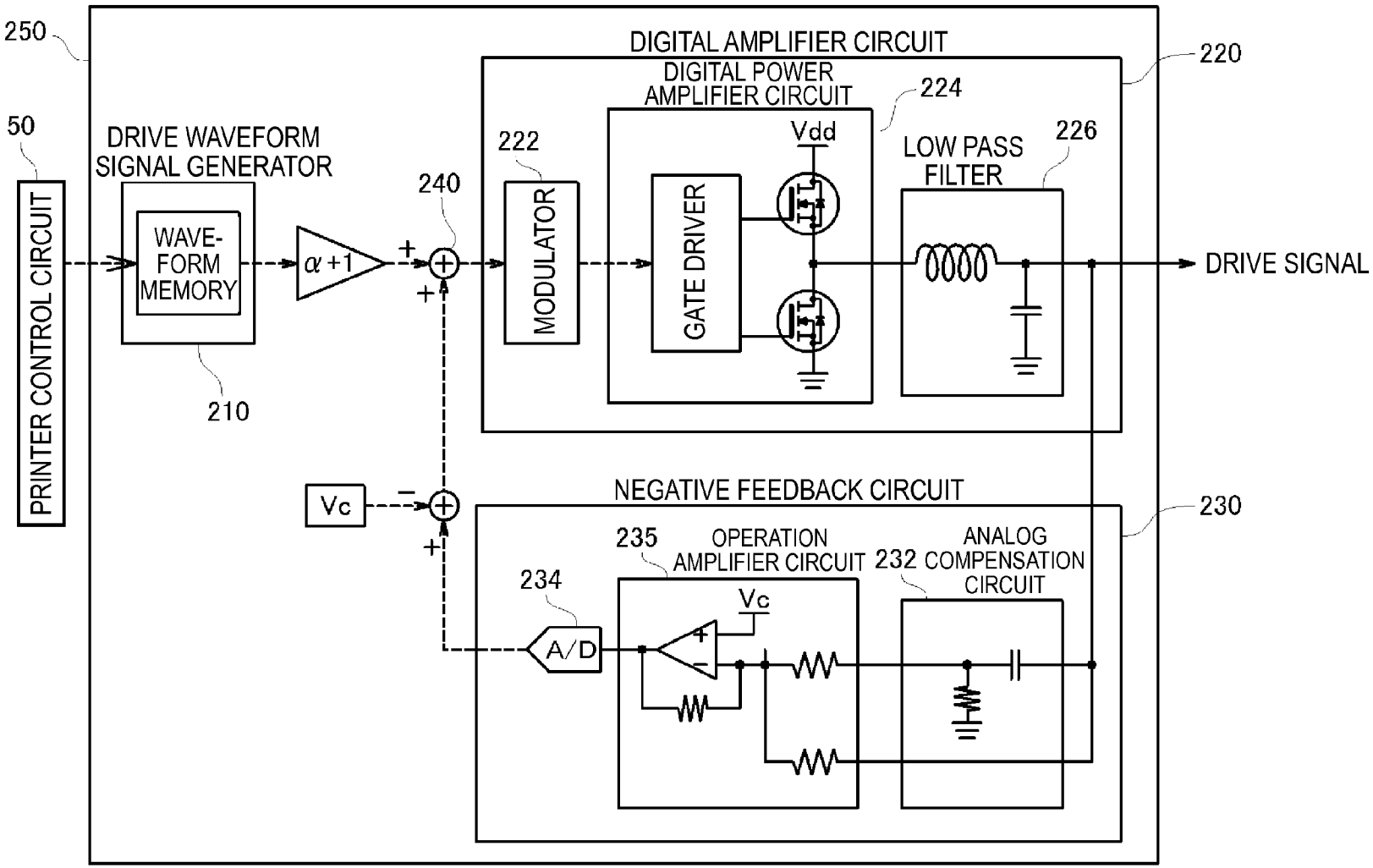
FIG. 14 is an explanatory diagram illustrating the configuration of a capacitive load driving circuit according to a second modified example.

In the first embodiment or the second embodiment described above, since the output of the analog compensation circuit 232 has a waveform that swings to the positive and negative sides, a power supply of a positive voltage and a power supply of a negative voltage are necessary for performing A/D conversion of this waveform. Accordingly, as shown in FIG. 14, it may be configured such that, by adding a bias voltage Vc to the non-inverted input terminal of the arithmetic amplifier circuit 235, a waveform that swings only to the positive voltage side is output, and after A/D conversion thereof is performed by the A/D converter 234, immediately before the negative feedback, the bias voltage Vc may be subtracted therefrom. In such a case, since the voltage supply of the negative voltage is not necessary, the size of the circuit can be decreased. In addition, the voltage-dividing circuit 232*b* as used in the second embodiment does not need to be used, and, as shown in FIG. 14, a drive signal may be directly input to the arithmetic amplifier circuit 235 through a resistor. In such a case, the number of resistors can be decreased, and the capacitive load driving circuit can be implemented at low cost.

C-3. Third Modified Example

In the capacitive load driving circuit 250 according to the second embodiment, as the voltage-dividing ratio $\alpha/G$ is increased, the influence of the external disturbance can be suppressed as that much. However, the increasing of the voltage-dividing ratio $\alpha/G$ is not different from increasing of the gain at the time of the negative feedback. Accordingly, in a case where the voltage-dividing ratio $\alpha/G$ is excessively increased so as to suppress the influence of the external disturbance, there is a concern that the control system becomes unstable. Thus, the digital waveform output by the driving waveform generator 210 may be compensated in advance, for example, by using an inverted filter that eliminates the influence of the number of piezoelectric devices that are simultaneously driven in a case where the plurality of capacitive loads shown in FIG. 2 are selected so as to be driven or by using an inverted filter that eliminates the influence of the replacement of the ejection unit 80 in a case where the replacement of the ejection unit 80 as shown in FIG. 13 is performed.

Figure 15:
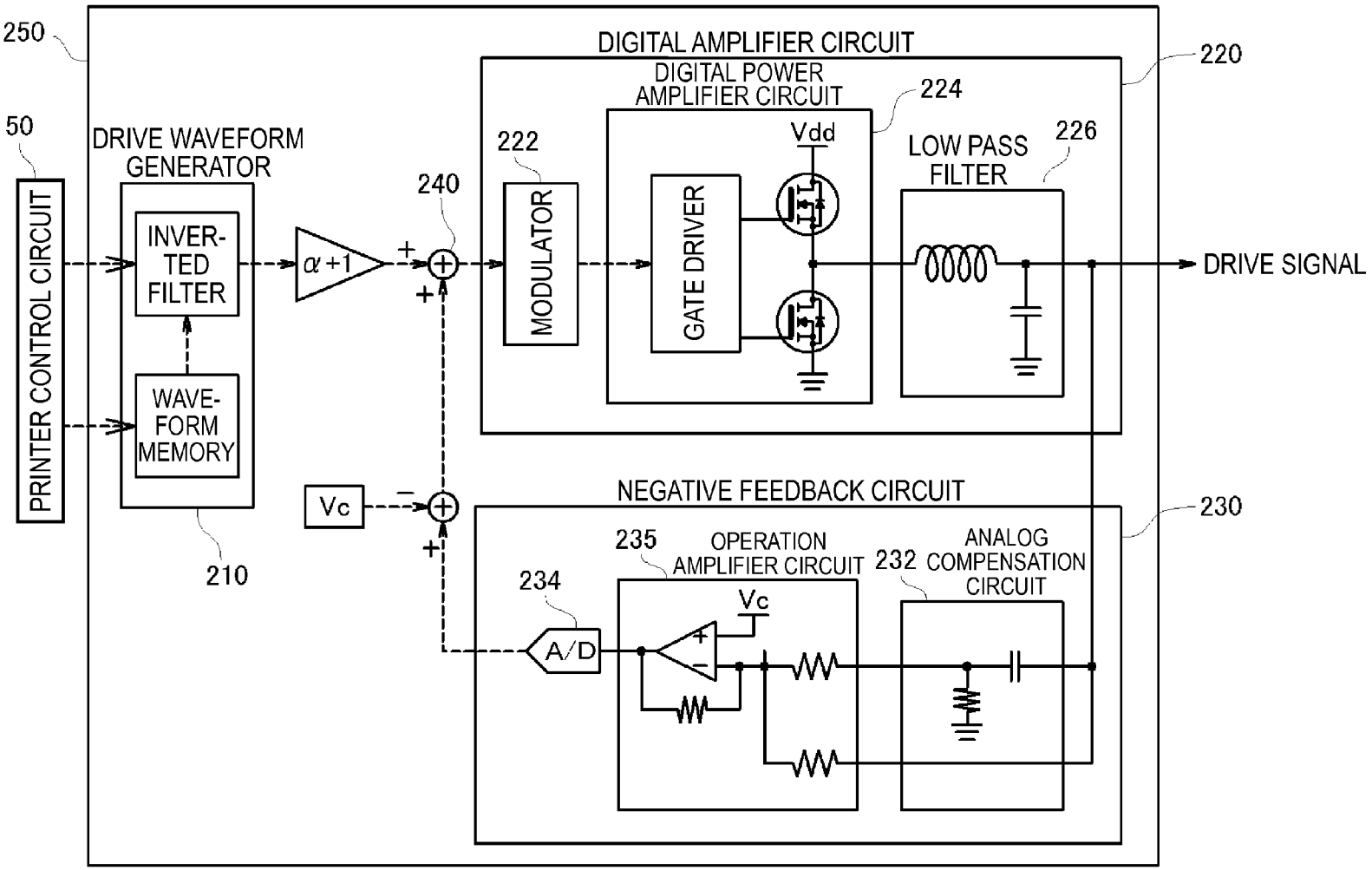
FIG. 15 is an explanatory diagram illustrating the configuration of a capacitive load driving circuit according to a third modified example.

FIG. 15 is an explanatory diagram illustrating the configuration in which the inverted filter is inserted into the driving waveform generator 210. The number of the gate devices 302 set to be in the conductive state in advance by the printer control circuit 50 or the degradation (the appearance of change in the gain according to the frequency) of the gain characteristics for each ejection unit 80 is checked in advance, and an inverted filter that eliminates the degradation is acquired. After the inverted filter, which is acquired in advance, is applied to the drive waveform signal output by the driving waveform generator 210, a resultant signal may be input to the control system.

It is apparent that, in order to eliminate all the influence of the number of piezoelectric devices driven simultaneously and the replacement of the ejection unit 80 by using only the inverted filter, the inverted filter needs to be set with high accuracy. However, in a case where the inverted filter is used in addition to the capacitive load driving circuit 250 according to the second embodiment, in the state in which the influence is roughly eliminated by using the inverted filter, the influence of the external disturbance can be suppressed in accordance with the voltage-dividing ratio $\alpha/G$. As a result, a drive signal having high accuracy can be stably output with scarcely being influenced by the number of piezoelectric devices driven simultaneously or the replacement of the ejection unit 80.

As above, although the capacitive load driving circuit according to this embodiment has been described, the invention is not limited to all the embodiments and the modified examples described above and may be performed in various forms within the scope not departing from the concept thereof. For example, by applying the capacitive load driving circuit according to this embodiment to various electronic apparatuses including medical apparatuses such as a fluid ejecting apparatus used for forming microcapsules containing a pharmaceutical preparation or nutrients and the like, a miniaturized electronic apparatus having high power efficiency can be provided.

This application claims priority to Japanese Patent Application No. 2010-254577, filed on Nov. 15, 2010, the entirety of which is hereby incorporated by reference.

What is claimed is:

1. A medical apparatus comprising:

an actuator that is used for ejecting liquid; and a capacitive load driving circuit that generates a drive signal used for driving the actuator, The capacitive load driving circuit that applies the drive signal to the capacitive load, the capacitive load driving circuit comprising:

a driving waveform signal output circuit that outputs a drive waveform signal that is a reference for the drive signal in a form of a digital signal;

a digital arithmetic circuit that outputs a digital compensation signal generated in the form of the digital signal based on the drive signal to the drive waveform signal as negative feedback;

a modulator that generates a modulated signal by performing pulse modulation of the output of the digital arithmetic circuit;

a digital power amplifier circuit that generates a power-amplified modulated signal by performing power amplification of the modulated signal;

a low pass filter that generates the drive signal applied to the capacitive load by smoothing the power-amplified modulated signal having a pulse wave form;

a first analog compensation circuit that performs phase-leading compensation for the drive signal applied to the capacitive load; and a digital conversion circuit that converts an output of the first analog compensation circuit into the digital signal and supplies the converted digital signal to the digital arithmetic circuit as the digital compensation signal.

2. A medical apparatus according to claim 1, further comprising a second analog compensation circuit that is disposed in parallel with the first analog compensation circuit and divides a voltage of the drive signal applied to the capacitive load at a predetermined voltage-dividing ratio, wherein an analog signal acquired by composing an output of the first analog compensation circuit and an output of the second analog compensation circuit is output to the digital conversion circuit.

3. A medical apparatus according to claim 1, further comprising an arithmetic amplifier circuit that is disposed on an input side of the digital conversion circuit and lowers an input impedance of the digital conversion circuit.

4. A medical apparatus according to claim 3, wherein an output of the arithmetic amplifier circuit is biased with a predetermined bias voltage, and a value corresponding to the voltage bias is subtracted from an output of the digital conversion circuit.

5. A medical apparatus comprising:

an actuator that is used for ejecting liquid; and a capacitive load driving circuit that generates a drive signal used for driving the actuator, wherein the capacitive load driving circuit is the capacitive load driving circuit according to claim 1.

* * * * *